US007735408B1

(12) United States Patent
Becker et al.

(10) Patent No.: US 7,735,408 B1
(45) Date of Patent: Jun. 15, 2010

(54) MORTAR TUBE WITH COOLING FIN

(75) Inventors: Richard Becker, Gloversville, NY (US); Mark Witherell, Wynantskill, NY (US); Jose Santiago, Dover, NJ (US); George E. Hathaway, IV, Sprakers, NY (US); Steve Tauscher, Schuylerville, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 887 days.

(21) Appl. No.: 11/162,740

(22) Filed: Sep. 21, 2005

Related U.S. Application Data

(60) Provisional application No. 60/522,565, filed on Oct. 14, 2004.

(51) Int. Cl.
*F41F 1/06* (2006.01)

(52) U.S. Cl. ..... 89/37.05; 222/612; 102/374; 102/445; 89/40.02

(58) Field of Classification Search ..... 89/47, 89/37.05, 40.2, 14.05, 1.35, 26, 37; 222/611.2, 222/288, 612; 52/749.1, 750; 102/373–380, 102/444–447, 430, 473, 501; 16/108; 42/69.01, 42/76.01; 285/331, 390, 95
See application file for complete search history.

(56) References Cited

U.S. PATENT DOCUMENTS 1,384,769 A * 7/1921 MacLaren ..... 124/3
1,439,446 A * 12/1922 Regan ..... 52/603
1,541,765 A * 6/1925 Hodge ..... 102/462
1,994,490 A * 3/1935 Skinner ..... 102/373
2,086,520 A * 7/1937 Baumann ..... 89/14.1
2,129,875 A * 9/1938 Rost ..... 89/7
2,239,662 A * 4/1941 Bailey ..... 122/6 A
2,564,497 A * 8/1951 Navias ..... 431/356
2,801,804 A * 8/1957 Frankert ..... 241/183
2,981,155 A * 4/1961 Parlanti ..... 89/16
4,092,814 A * 6/1978 Kern ..... 52/853
4,095,433 A * 6/1978 Yamamoto et al. ..... 405/288
4,098,190 A * 7/1978 Gawlick et al. ..... 102/445
4,641,567 A * 2/1987 Creedon ..... 89/8
5,385,274 A * 1/1995 Twyman ..... 222/327
5,677,507 A * 10/1997 Becker et al. ..... 89/47
5,804,759 A * 9/1998 Sauvestre ..... 102/439
6,508,159 B1 * 1/2003 Muirhead ..... 89/14.1
6,679,156 B1 * 1/2004 Danou ..... 89/14.1

FOREIGN PATENT DOCUMENTS

DE 4425057 A1 * 1/1996

* cited by examiner

*Primary Examiner*—Jeanette Chapman
(74) *Attorney, Agent, or Firm*—John F. Moran

(57) ABSTRACT

A cooling fin for a mortar tube comprises a plurality of discrete nibs disposed on an external surface of the mortar tube wherein the nibs are arranged in longitudinal rows spaced circumferentially around the mortar tube. Preferably, the number of longitudinal rows of nibs is thirty-six. The nibs have a substantially square cross-section.

8 Claims, 3 Drawing Sheets

MORTAR TUBE WITH COOLING FIN

CROSS-REFERENCE TO RELATED APPLICATIONS

This application claims the benefit under 35 USC 119(e) of U.S. provisional patent applications 60/522,565 filed on Oct. 14, 2004, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to mortar tubes and in particular to mortar tubes having fins for cooling the mortar tube.

Some known mortar tubes, such as the U.S. Army's 81 mm mortar tube, have cooling fins that function to reduce the tube temperature during firing. These fins are expensive to manufacture and add weight to the mortar tube. The present invention is a novel cooling fin for mortar tubes.

SUMMARY OF THE INVENTION

It is an object of the invention to provide a finned mortar tube that is less expensive than known finned mortar tubes.

It is another object of the invention to provide a finned mortar tube that is more efficient in transferring heat than known finned mortar tubes.

It is a further object of the invention to provide a mortar tube with discrete cooling nibs that are substantially square in cross-section.

One embodiment of an apparatus in accordance with the invention comprises a mortar tube; and a plurality of discrete nibs disposed on an external surface of the mortar tube, the nibs being arranged in longitudinal rows, the longitudinal rows being spaced circumferentially around the mortar tube. Typically, the plurality of discrete nibs are disposed on a rear portion of the mortar tube. Preferably, the nibs have a substantially square cross-section.

In one embodiment, a number of longitudinal rows of nibs is thirty-six, the thirty-six longitudinal rows being circumferentially spaced apart at ten degree intervals. Preferably, a longitudinal spacing of the nibs is about 0.2 inches and a side of the substantially square cross-section is about 0.1 inches long. A height of the nibs is preferably about 0.2 inches.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention is a new cooling fin design for mortar tubes. The inventive fins are lighter, more efficient in transferring heat and cheaper to manufacture than known fins. The machining process for the inventive fins is less expensive than the machining process for the known continuous fins. The square cross-section of the nibs of the invention results in more efficient heat transfer than the known continuous fins. Because the invention is more efficient in transferring heat, the wall of the mortar tube may be made thinner, which reduces the amount of material needed and, therefore, the cost of the mortar tube.

Figure 1A:
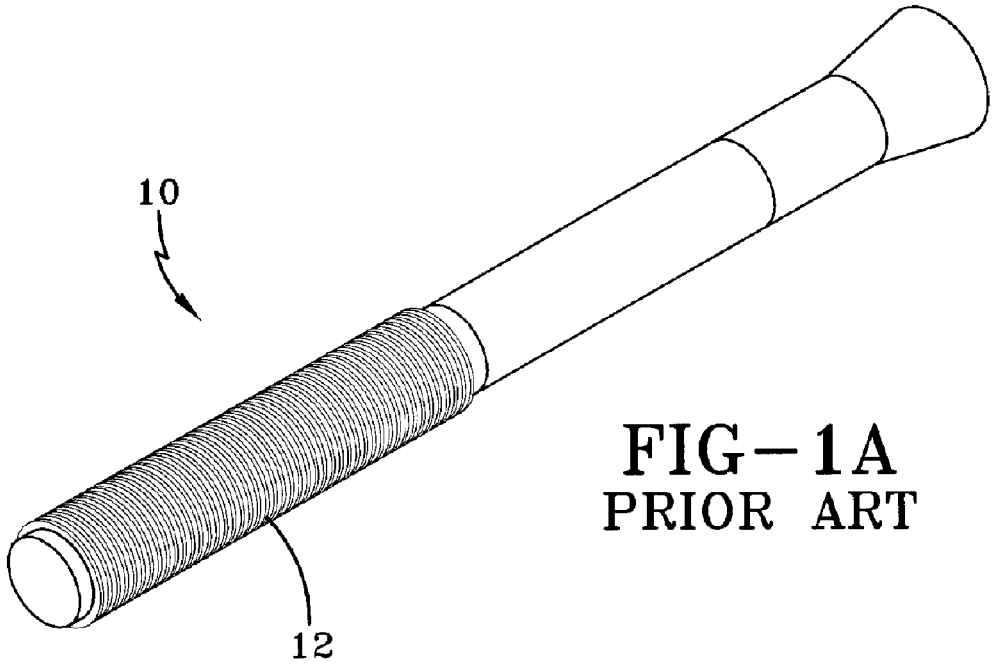
FIG-1A PRIOR ART
FIG. 1A is a perspective view of a known mortar tube.
Figure 1B:
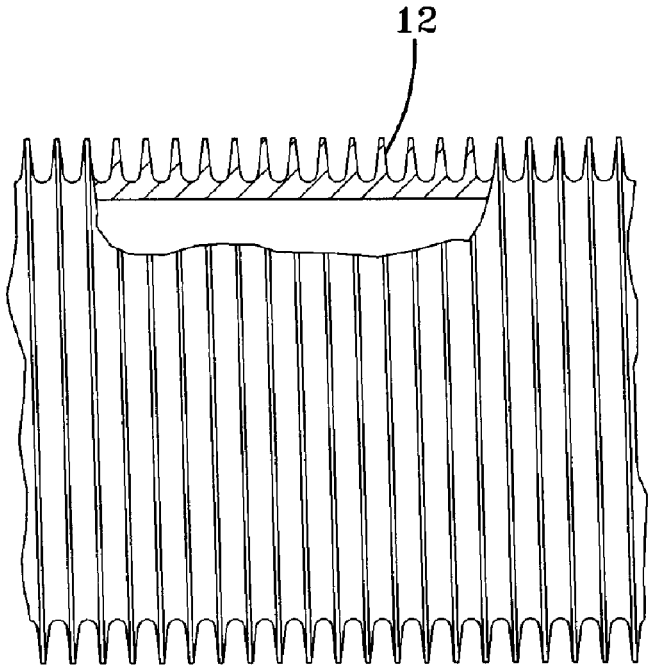
FIG-1B PRIOR ART
FIG. 1B is a fragmentary side view, partially in section, of a portion of the tube of FIG. 1A.

FIG. 1A is a perspective view of a known mortar tube 10 with continuous fins 12. FIG. 1B is a fragmentary side view, partially in section, showing the continuous fin 12 of FIG. 1A. The continuous fin 12 extends circumferentially around tube 10 and longitudinally along tube 10. The known fins 12 are expensive to manufacture and add much weight to the mortar tube 10.

The maximum rate of fire (ROF) of an 81 mm mortar tube is 30 rounds per minute for 2 minutes and 15 rounds per minute sustained. This ROF is based on mortar ammunition with maximum pressures of 15,800 psi. At the maximum ROF, a finless mortar tube would reach temperatures of 1160° F. When the tube 10 is equipped with known cooling fins 12, the temperature is reduced to 1022° F. The temperature can be further reduced by substituting the inventive fins for the known fins 12. The reduction in temperature allows the mortar tube to be constructed with a thinner wall thickness. The thinner wall thickness saves material and reduces the weight of the mortar tube, which is always desirable for the soldier. The reduction in material also reduces cost.

Figure 2A:
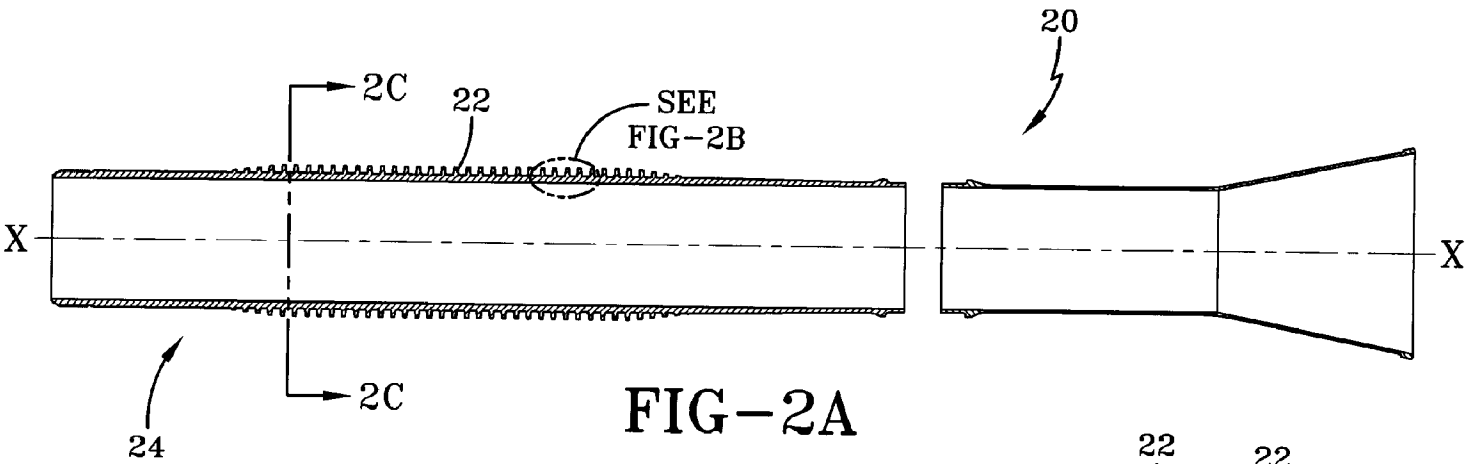
FIG. 2A is a side sectional view of one embodiment of a mortar tube in accordance with the invention.
Figure 2C:
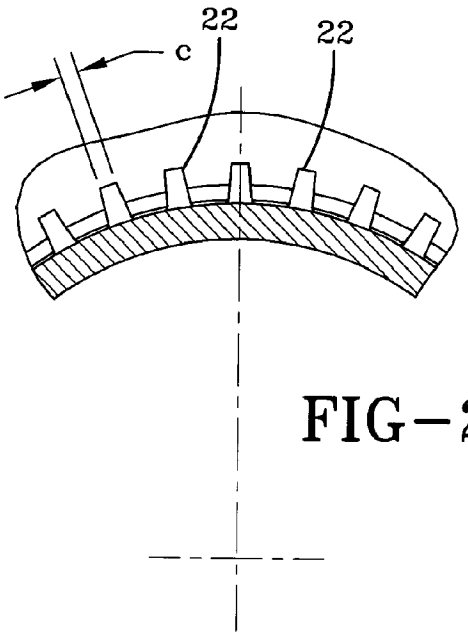
FIG. 2C is a partial sectional view along the line 2C-2C of FIG. 2A.
Figure 2B:
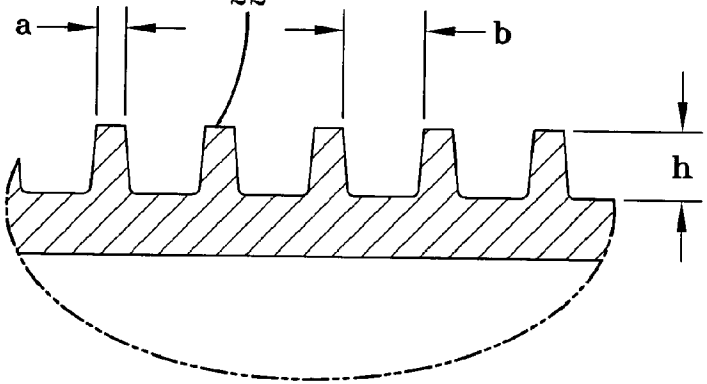
FIG. 2B is an enlarged view of a portion of FIG. 2A.
Figure 3B:
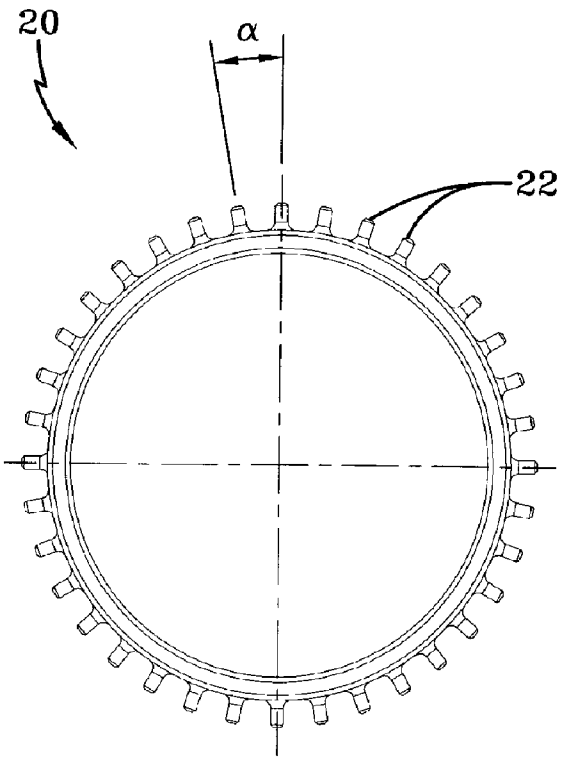
FIG. 3B is an end view of FIG. 3A.
Figure 3A:
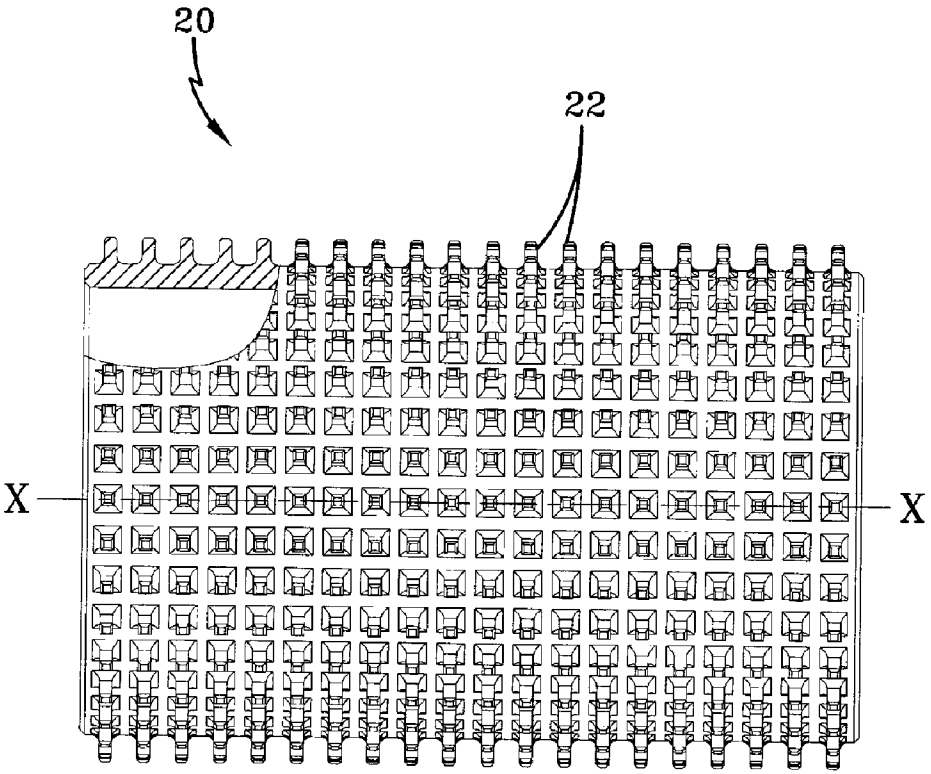
FIG. 3A is a side view of the finned portion of the tube of FIG. 2A, partially in section.

FIG. 2A is a side sectional view of one embodiment of a mortar tube 20 in accordance with the invention. FIG. 2B is an enlarged view of a portion of FIG. 2A. FIG. 2C is a partial sectional view along the line 2B-2B of FIG. 2A. FIG. 3A is a side view of the finned portion of tube 20, partially in section. FIG. 3B is an end view of FIG. 3A. Mortar tube 20 has a longitudinal axis X-X. A rear portion 24 of the tube 20 includes a plurality of discrete nibs 22 disposed on its external surface. Nibs 22 are arranged in longitudinal rows (FIG. 3A) parallel to axis X-X and the longitudinal rows are spaced circumferentially around the mortar tube 20 (FIGS. 2C and 3B).

The length of tube 20 on which the nibs 22 are formed may vary as needed. In general, the longitudinal extent of the nibs 22 is in the range of about one foot to about 18 inches. As best seen in FIG. 3B, the number of longitudinal rows of nibs 22 is preferably thirty-six. The thirty-six longitudinal rows have a circumferential spacing alpha, where alpha is ten degrees. As shown in FIG. 2B, the longitudinal spacing b of the nibs 22 is preferably about 0.2 inches.

Nibs 22 preferably have a substantially square cross-section. FIG. 2B shows a longitudinal side a of a nib 22 having a length of about 0.1 inches. Similarly, as shown in FIG. 2C, the circumferential side c has a preferred length of about 0.1 inches. As shown in FIG. 2B, nibs 22 have a height h that is preferably about 0.2 inches. As best seen in FIG. 2A, it is preferable that the nibs 22 gradually increase in height from zero at the breech end to a maximum height h and then taper back down to zero. This tapered feature makes the tube 20 easier for soldiers to handle and helps reduce damage to the nibs 22 if the tube is dropped to the ground.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus, comprising:

a muzzleloading mortar tube for launching projectiles, the mortar tube having an external surface and a longitudinal axis; and a plurality of discrete nibs disposed on the external surface of the mortar tube for cooling the mortar tube by transferring heat, the nibs being arranged in longitudinal rows, the longitudinal rows being spaced circumferentially around the outside of the mortar tube; and wherein a height of the nibs increases tom zero toward a breech end of the mortar tube to a maximum height and then decreases back to zero towards a muzzle end of the mortar tube.

2. The apparatus of claim 1 wherein the maximum height of the nibs is about 0.2 inches.

3. The apparatus of claim 1 wherein the plurality of discrete nibs are disposed on a rear portion of the mortar tube.

4. The apparatus of claim 1 wherein the nibs extend longitudinally on the external surface in the range of about one foot to about 18 inches.

5. The apparatus of claim 1 wherein the plurality of nibs includes a number of longitudinal rows of nibs being thirty-six, the thirty-six longitudinal rows being circumferentially spaced apart at ten degree intervals on the external surface.

6. The apparatus of claim 1 wherein a longitudinal spacing of the nibs is about 0.2 inches.

7. The apparatus of claim 1 wherein each of the nibs has a substantially square cross-section.

8. The apparatus of claim 1 wherein a side of the substantially square cross-section is about 0.1 inches long.

* * * * *